US005416943A

United States Patent [19]

Weltikol et al.

[11] Patent Number: 5,416,943

[45] Date of Patent: May 23, 1995

[54] HIGH SPEED CONVERSION MEANS FOR FLOOR TREATING MACHINES

[76] Inventors: Larry E. Weltikol, 606 Holiday Village, Minot, N. Dak. 58701; Paul T. Grossman, 1109 Sunrise Dr., R.R. 3, Hazen, N. Dak. 58545

[21] Appl. No.: 252,196

[22] Filed: Jun. 1, 1994

[51] Int. Cl.[6] ..... A47L 11/16

[52] U.S. Cl. ..... 15/49.1; 15/98; 299/41; 451/353

[58] Field of Search ..... 15/49.1, 50.1, 98, 385; 51/177, 170 T; 299/41

[56] References Cited

U.S. PATENT DOCUMENTS 2,857,613 10/1958 Meyerhoefer ..... 15/49.1
3,145,585 8/1964 Brown ..... 15/49.1

*Primary Examiner*—Edward L. Roberts, Jr.

[57] ABSTRACT

A high-speed conversion for floor treating machines which comprises a wheeled frame, an impeller member attached to the floor treating drive of a floor treating machine for rotation therewith, a plurality of speed accelerators fixedly attached to the impeller member and having an end portion thereof engaging the frame and having an opposite end portion fixedly attached to a roller for engaging a floor treating element support which is rotatably journaled to the impeller member. A floor treating element such as a brush, pad, or sand paper is fastenable to the floor-facing side of the floor treating element support for rotatable engagement to the floors. In operation, the impeller member rotates at a speed up to 300 rpm and the speed accelerators rotate the floor treating element and support at speeds capable of exceeding 2500 rpm. Because of such high speeds, the high-speed floor treating elements can burnish, strip, sand paper, wax, and clean the floors more conveniently, faster, and more effectively than slower speed floor treating elements on floor treating machines not using this invention.

19 Claims, 9 Drawing Sheets

HIGH SPEED CONVERSION MEANS FOR FLOOR TREATING MACHINES

BACKGROUND OF THE INVENTION

This invention relates to a high-speed conversion means for floor treating machines to substantially increase the effectiveness of buffers, in particular, as to burnishing, stripping, scrubbing, and sanding floors.

Floor treating machines such as carpet cleaners, buffers, floor stripping machines, floor waxing machines, and floor sanding machines as such are known in art. The prior art includes machines which conventionally have a straight drive mechanism for actuating the floor treating elements thereunder. The drive shaft from the motor is connected directly to the rotatable element support member. The drive shaft in such machines typically rotate at from 175 rpm to 300 rpm which is also the speed of the rotatable element support member and floor treating member since the drive shaft is connected directly to the element support member. None of the prior art describes a drive mechanism which increases the speed of the floor treating element or elements on the floor treating machine in excess of 2500 rpm which is the speed the high-speed conversion means of the present invention can achieve and which produces exceptional results on the floors.

One known prior art are POWER DEVICES HAVING REVERSIBLE DRIVE, U.S. Pat. No. 3,451,495, a base for contacting a surface to be treated, a wheel rotatably mounted on the base, a strain wave gearing assembly having a plurality of gears wherein one of the gears rotates in an opposite direction from the others effectively reversible drive in the devices.

Another known prior art is a NOISE REDUCTION OF GEAR TRAIN, U.S. Pat. No. 3,469,470, comprising a gear train having a steel pinion gear meshed with a nylon gear wheel which is meshed with a pair of "Rexin" gear wheels which aluminum inserts for reducing the noise in the gear train.

Another known prior art is a HIGH-SPEED POLISHING MACHINE, U.S. Pat. No. 4,115,890, comprising a platform, wheels at a rear portion of the platform, a housing at a forward portion of the platform, a rotatable pad driver supported by the housing, a motor mounted on an intermediate portion of the platform to provide a straight drive to the pad driver, and handles to use the machine.

Another known prior art is a HIGH-SPEED FLOOR TREATING MACHINE, U.S. Pat. No. 4,122,576, comprising a frame, handle means attached to the frame, a support for the frame, an electric motor mounted on the frame, a floor treating means comprising an annular shaped brush, which is rotated with a belt and pulley carried by the drive shaft of the motor.

Another known prior art is a HIGH SPEED FLOOR POLISHER, U.S. Pat. No. 4,358,868, comprising a frame, wheels, suspension means for suspending the frame, and drive means directly connected to a motor, for rotating a floor treatment element.

Another known prior art is a FLOOR CLEANING AND POLISHING MACHINE, U.S. Pat. No. 4,393,534, comprising a disk, support for the disk, means for imparting rotational motion to the support, and a variant speed element which geared from the power source.

Another known prior art is a MACHINE FOR FLOOR MAINTENANCE, U.S. Pat. No. 4,590,635, comprising a body, an annular stator supported by the body, a shaft disposed in the stator, and an annular rotor journaled for rotation about the shaft.

Another known prior art is a FLOOR TREATING MACHINE, U.S. Pat. No. 4,633,541, comprising a frame, a brush housing connected to the frame, a brush for treating the floor, and means for positioning the brush with respect to the floor.

Another known prior art is a FLOOR POLISHER, U.S. Pat. No. 4,910,824, comprising a vertically moving mechanism adapted to move said pad in a vertical direction, a ground pressure adjusting mechanism for maintaining a ground pressure on the pad, and a floor protecting mechanism to control the vertically moving mechanism.

Another known prior art is an ADJUSTABLE SUSPENSION FOR HIGH SPEED PAD DRIVER, U.S. Pat. No. 5,127,124, comprising a housing, wheels, a drive motor, and pulley arrangement for rotating a circular pad attached to a mounting plate, and an apparatus for positioning the mounting plate over a range of heights above the floor to accommodate a range of pad thicknesses.

None of the prior art described above anticipates, suggests, or describes a high-speed conversion means which will dramatically increase the speed of the floor treating elements relative to the speed of the drive shaft of the motor to substantially enhance the treatment of the floors as such. There is a need for a high-speed conversion means for floor treating machines which substantially increases the speed and performances of such machines.

SUMMARY OF THE INVENTION

This invention relates to a high-speed conversion means for floor treating machines comprising a height adjustable and moveable frame having a circular stator means at a forward portion thereof and having a pair of wheels with stems lockingly threaded through a rearward portion opposite the stator means and further having a third wheel also having a stem lockingly threaded through the forward portion of the frame. An impeller member is securely attachable to the floor treating drive means of floor treating machines for rotation therewith and is rotatably received in the stator means. A plurality of speed accelerator means are circumferentially spaced apart near the perimeter of the impeller member and are fixedly attached with clamps to the bottom side of the impeller member. A floor treating element support adapted to rotate independently of the impeller member is rotatably journaled to the impeller member and is spaced from the impeller member and has a side which is engageable to the speed accelerator means which drive the floor treating element support to speeds capable of exceeding 2500 rpm. The speed accelerator means have spindles arranged parallel to the bottom side of the impeller member and which are rotatably actuated by the stator means of the frame which effects rotation of the spindles as the impeller member is rotated by the floor treating drive means of the floor treating machines. At least one floor treating element such as a brush, pad, or sand paper is attachable to the floor treating element support for rotatably engaging the floor during operation of the floor treating machines.

One objective of the present invention is to provide a high-speed conversion means for floor treating machines which treat floors more effectively because of the speed attainable by the high speed conversion means than does the conventional prior art.

Another objective of the present invention is to provide a high-speed conversion means for floor treating machines which is capable of accelerating a floor treating element in excess of 2500 rpm which far exceeds the speeds attainable by conventional floor treating elements which are known to rotate at only 300 rpm. Floor treating elements rotating at speeds in excess of 2500 rpm will burnish, strip, clean, and sand floors much better job than floor treating elements rotating at speeds of only 300 rpm.

Yet, another objective of the present invention is to provide a high-speed conversion means for floor treating machines which allows the floor treating machines to be conveniently and effectively operated by only one person unlike the prior art which requires at least two people to effecting operate the prior art.

Further objects and advantages of the present invention will become apparent as the description of the present invention proceeds and when taken in conjunction with the accompanying drawings wherein:

DETAILED DESCRIPTION OF THE DRAWINGS

Figure 1:
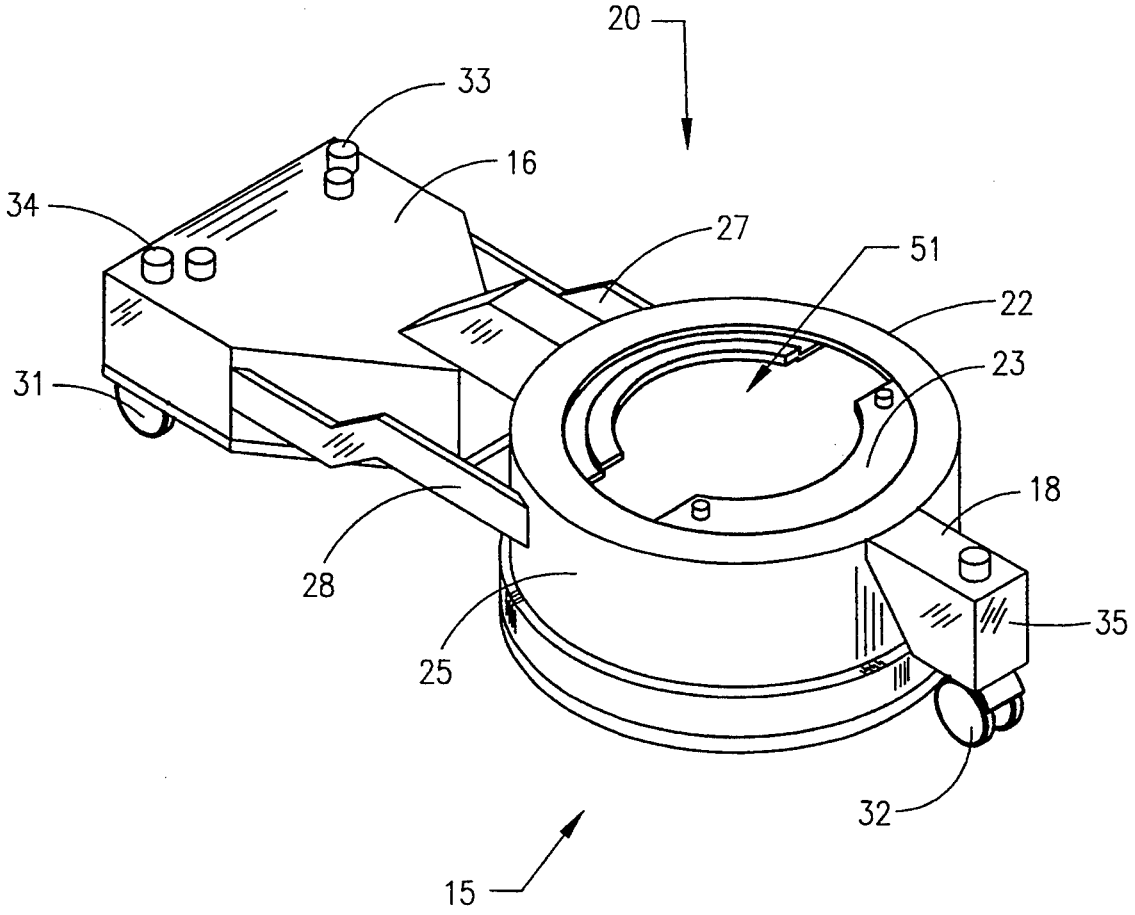
FIG. 1 is a top perspective view of the moveable frame of the high-speed conversion means for floor treating machines.
Figure 2:
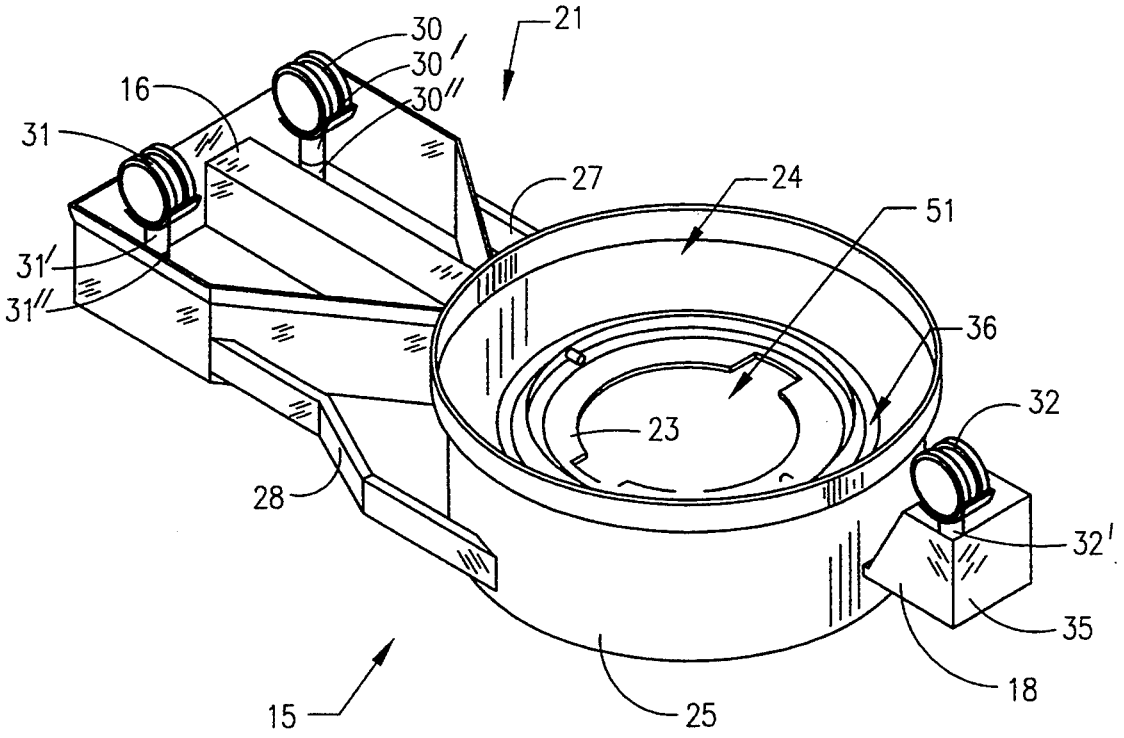
FIG. 2 is a bottom perspective view of the moveable frame of the high-speed conversion means for floor treating machines.
Figure 3:
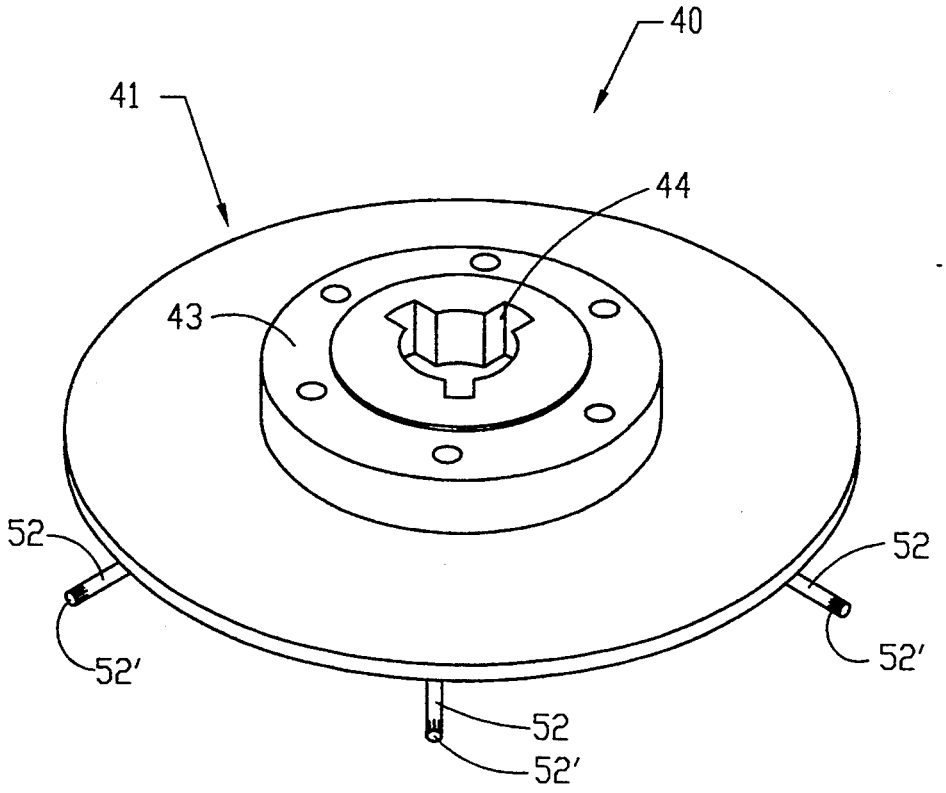
FIG. 3 is a top perspective view of the impeller member of the high-speed conversion means for floor treating machines.

Referring to the drawings in FIGS. 1 through 9, in particular, the high-speed conversion means 10 for floor treating machines 70 comprises a height adjustable and moveable frame 15 having a rearward portion 16, a forward portion 18, a bottom 21 and a top 20 and being disposed generally parallel to the floors 85 to support a floor treating machine 70 upon the floor 85. The frame 15 further comprises a pair of roller members having roller bodies 30 & 31 journaled to support brackets 30' & 31' and having stems 30'' & 31'' rotatably disposed in the support brackets 30' & 31' and lockingly threaded through the bottom 21 of the frame 15 in the rearward portion 16 thereof and also comprises a third roller member also having a roller body 32 journaled to a support bracket 32' and having a stem 32'' rotatably disposed in the support bracket 32' and lockingly threaded through the bottom 21 of the frame 15 in the forward portion 18 thereof to support and move the frame 15 upon the floors 85. The roller members have fasteners (not shown) such as nuts or the like which are threaded on the stems and which engage the bottom 21 and top 20 of the frame 15 and vertically set the frame 15 at the desired heights upon the floors 85 as selected by the user of the floor machine 70. Protective covers 33, 34, & 35 removably cover the top of the stems 30'', 31'', & 32'' of the roller members to protect the user during use of the floor treating machine 70. The frame 15 further has a stator means 22 forming much of the forward portion 18 thereof and having a top 23, an open bottom 24, and an annular side wall 25 being generally tapered outward from the top 23 to the open bottom 24. The top 23 of the stator means 22 has an opening 51 therethrough, which is shaped and dimensioned to receive the rotatable floor treating drive shaft of the floor treating machine 70 and is disposed generally parallel to the floor 85. An annular projection means 36 integrally extends from the top 23 inside the stator means 22. The annular projection means 36 has an abrasive or corrugated or ratchet downward facing outer surface. A pair of braces 27 & 28 have ends fixedly attached or welded to the exterior of the side wall 25 of the stator means 22 and have opposite ends fixedly attached or welded to the rearward portion 16 of the frame 15 to provide strength and support to the frame 15.

As shown in FIGS. 3–5, 8, & 9, an impeller member 40 being generally disk-shaped and having a top side 41 and a bottom side 42 and further having a generally cylindrical clutch member 43 integrally extending upward from a central portion of the top side 41. The clutch member 43 has a top end which has an aperture 44 therethrough, which is shaped and dimensioned to mountably receive the drive shaft of the floor treating drive means 72 of the floor treating machine 70. A bore 46 coaxially extends through a boss member centrally disposed on the bottom side 42 of the impeller member 40.

Figure 4:
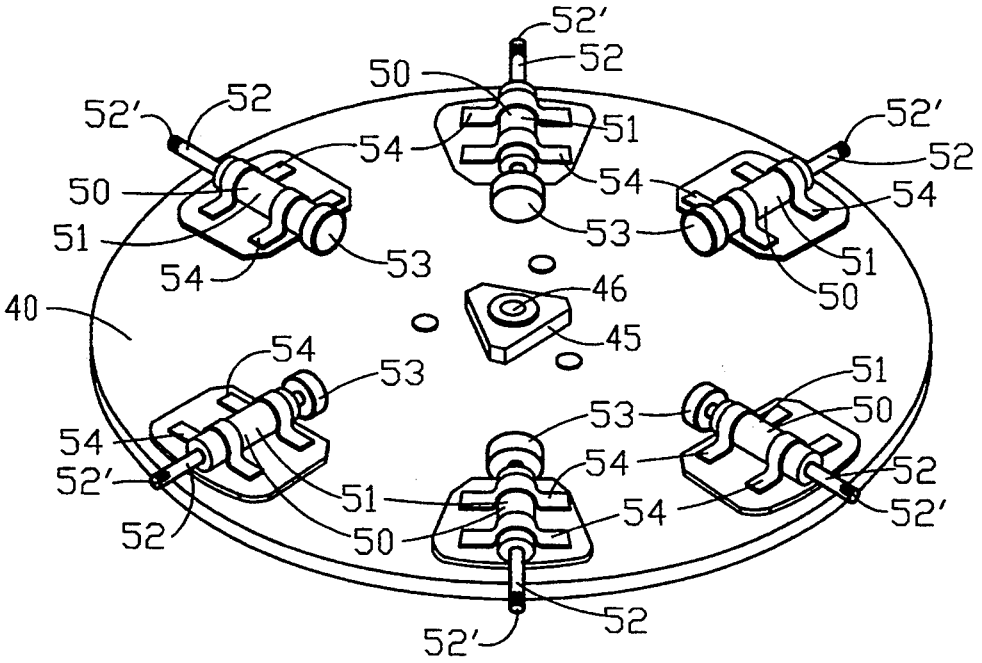
FIG. 4 is a bottom perspective view of the impeller member of the high-speed conversion means for floor treating machines.
Figure 5:
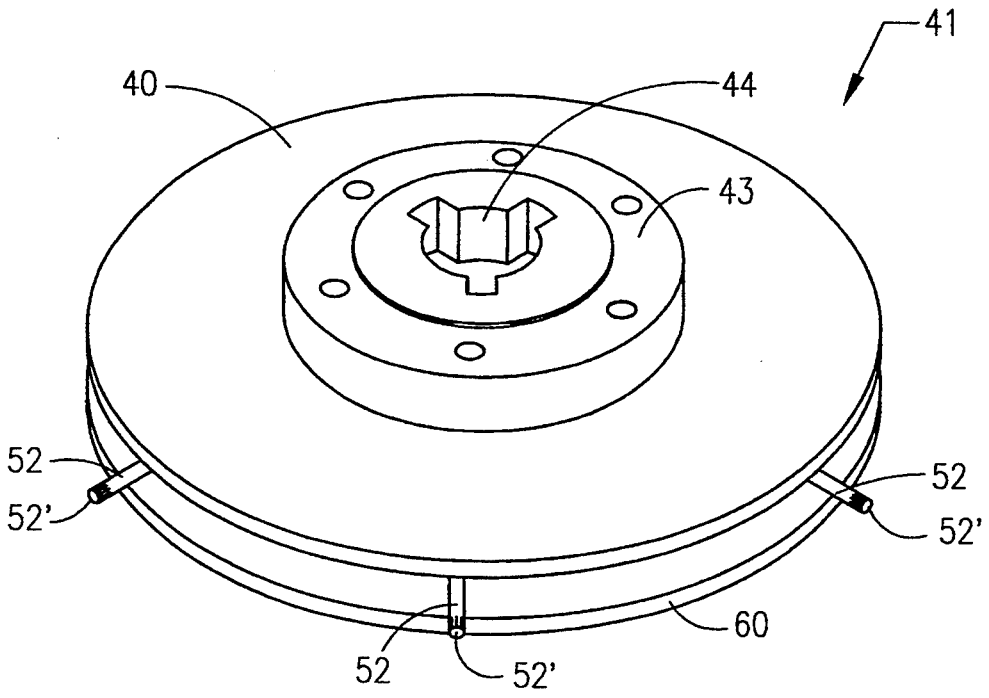
FIG. 5 is a perspective view of the impeller member attached to the floor treating element support of the high-speed conversion means.

As shown in FIGS. 4 & 5, six speed accelerator means are fixedly fastened with U-shaped clamps 54 and fasteners (not shown) such as rivets to the bottom side 42 of the impeller member 40 near the perimeter thereof and are circumferentially and generally equally spaced thereabout. The speed accelerator means each comprises a bearing member 51 having an elongate body preferably made of plastic and having a longitudinal bore (not shown) extending therethrough with a pair of bearings (not shown) disposed in the ends of the elongate body and securely held in the elongate body with spring clips (not shown); a spindle 52 rotatably journaled entirely through the elongate body of the bearing member 51 and having a first end and a second end 52'; and a disk-shaped roller means 53 such as a wheel having a corrugated rim and being fixedly attached at its center to the first end of the spindle 52 which has a corrugated or ratchet surface along a portion of the spindle 52 at the second end 52' thereof, said corrugated or ratchet portion of the spindle 52 extending outward beyond the perimeter of the impeller member 40 and being rotatably engageable to the downward facing surface 39 of the annular projection means 36 of the stator means 22, for traction on the downward facing surface 39 of the annular projection means 36 which engageably actuates rotation of the spindle 52 as the impeller member 40 moves about its axis and moves the speed accelerator means along with it, the impeller member 40 being driven by the floor treating drive means 72. Each of the spindles 52 further has a middle portion extending between the pair of bearings, which has a diameter larger than the portions of each spindle 52 journaled through the pair of bearings and which is engageable to the pair of bearings to substantially prevent the spindles 52 from moving and coming out of the bearings. The spindles 52 and elongate bodies of the bearing members 51 are disposed generally parallel to the bottom side 42 of the impeller member 40 and parallel to the surface of the annular projection means 36.

Figure 6:
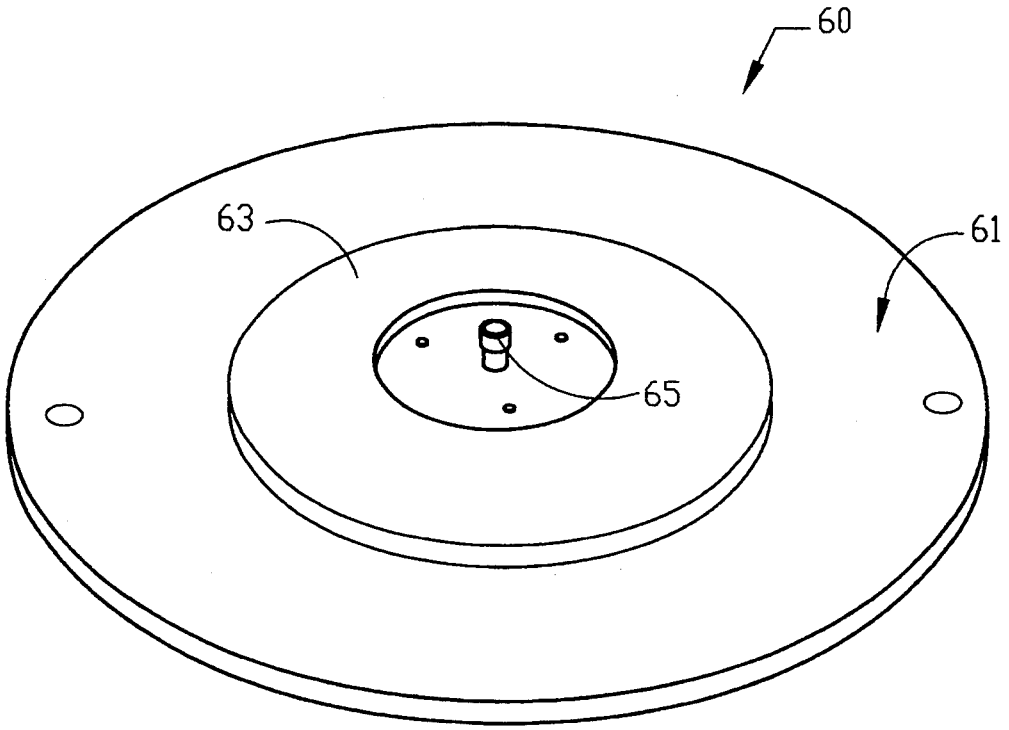
FIG. 6 is top perspective view of the floor treating element support of the high-speed conversion means.
Figure 7:
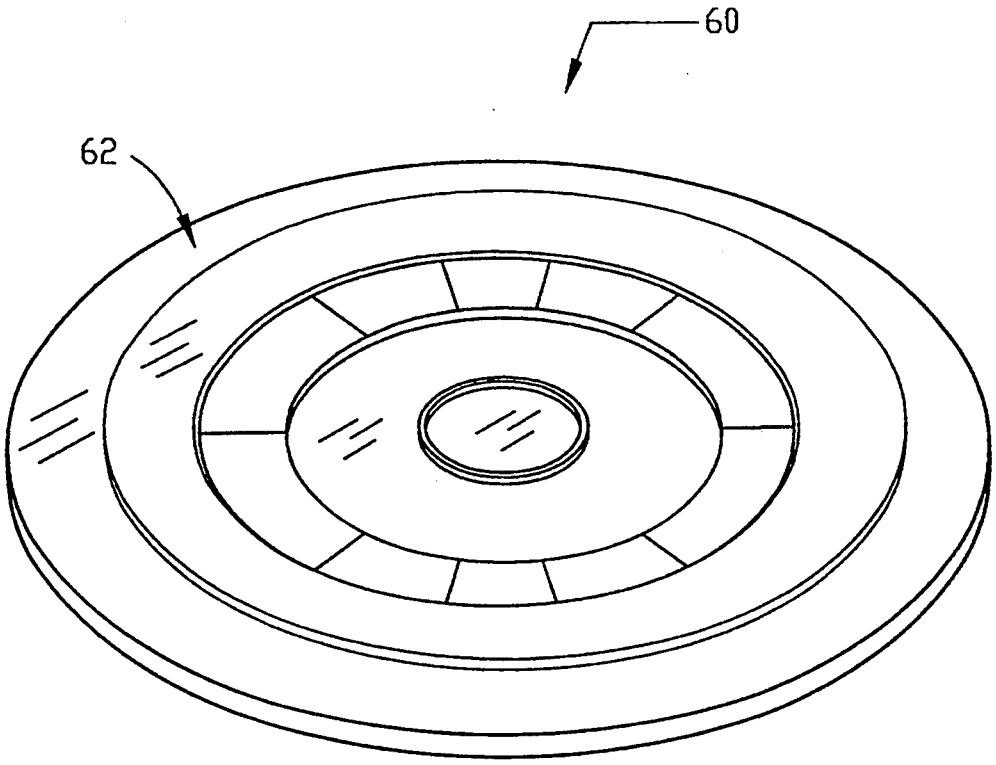
FIG. 7 is a bottom perspective view of the floor treating element support of the high-speed conversion means.

As shown in FIG. 5, a floor treating element support 60 is rotatably and securely journaled to the impeller member 40 through the bore extending through the center of the impeller member 40. As shown in FIGS. 6 & 7, the floor treating element support 60 is essentially disk-shaped and has a top side 61 and a floor-facing side 62 and further has a circular platform 63 preferably made of rubber and centrally raised upon the top side 61 of the floor treating element support 60 and having a circumference relatively smaller than the circumference of the floor treating element support 60. The rims of the roller means 53 of the speed accelerator means rotatably engages the surface of the rubber platform 63 near the perimeter thereof to effect rotation of the floor treating element support 60 at high speeds relative to the speed of the impeller member 40. As shown in FIG. 6, an axle member 65 is centrally and fixedly disposed in the top side 61 of the floor treating element support 60 and is connectively and rotatably journaled through the bore in the impeller member 40 and is securely held in the bore with a fastener member (not shown). One or more floor treating elements 68 such as pads, brushes, or sand paper are fastenable to the floor facing side 62 of the floor treating element support 60 with fastener means (not shown) for engagement to the floor 85 for burnishing, scrubbing, buffing, or sanding of the floor 85. The floor treating element support 60 is capable of rotating to speeds in excess of 2500 rpm; whereas, the impeller member 40 when actuated by the drive means 72 is capable of rotating at speeds up to 300 rpm.

Figure 8:
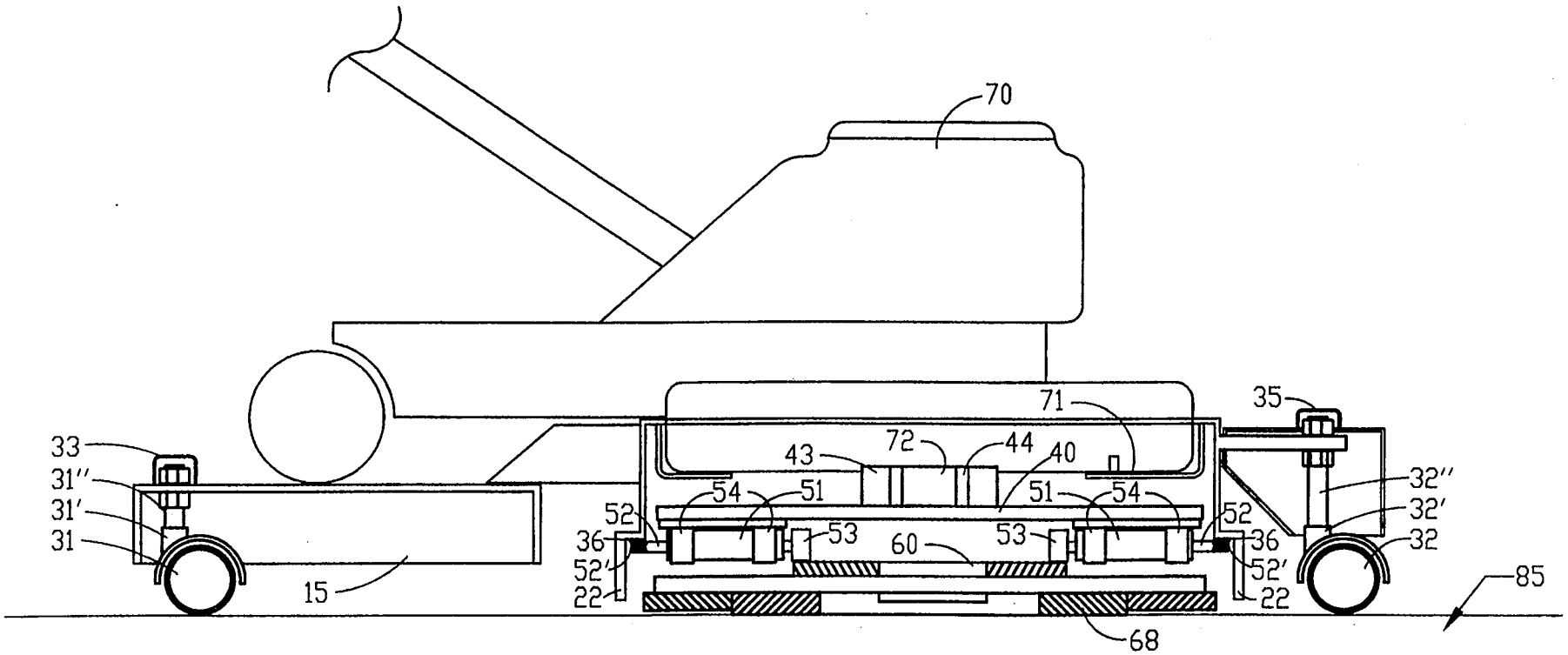
FIG. 8 is a cross-sectional side view of the high-speed conversion means on a floor treating machine taken along line 8—8 of FIG. 1.
Figure 9:
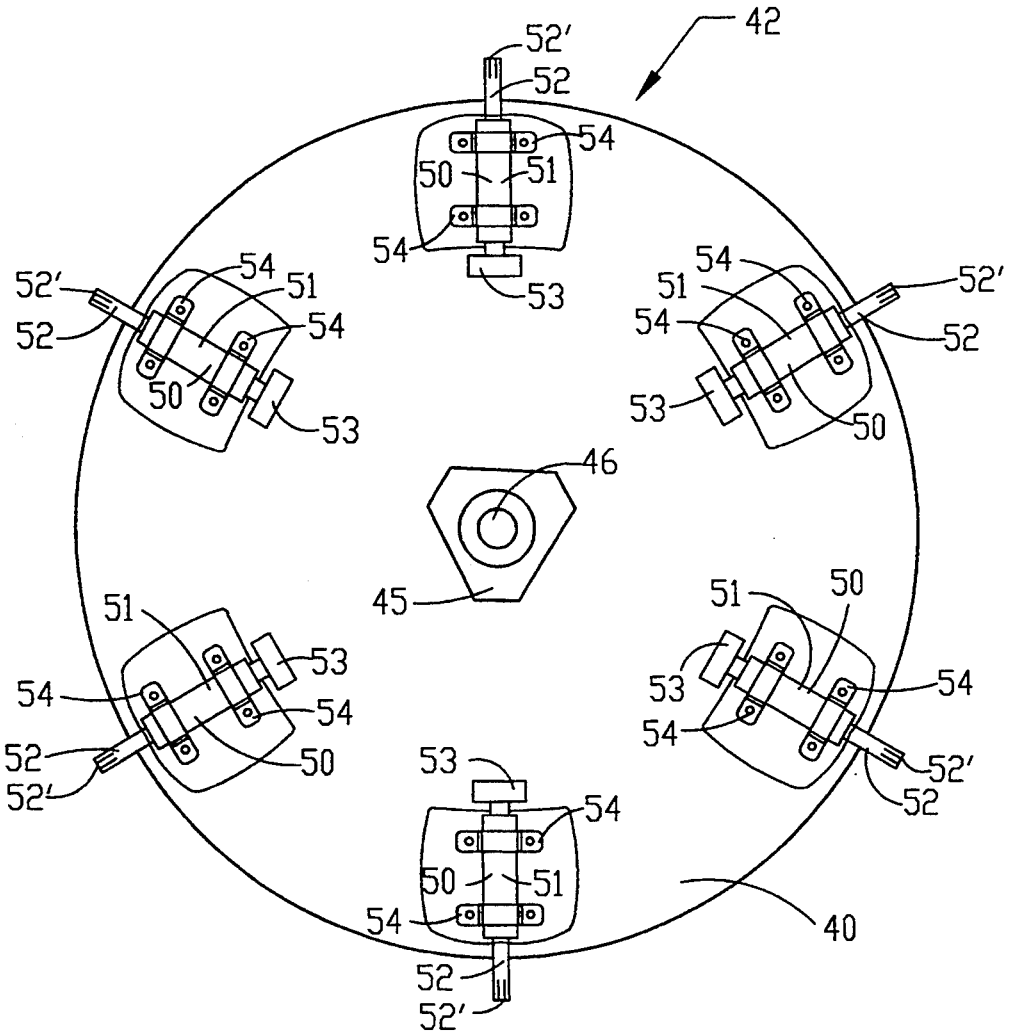
FIG. 9 is a bottom plan view of the impeller means and the speed accelerator means of the high speed conversion means.

As illustrated in FIGS. 8 & 9, to operate the high-speed conversion means 10 for floor treating machines 70, the user should mount a floor treating machine 70 upon the top 23 of the stator means 22 of the frame 15 with the floor treating drive means 72 extending through the opening 51 in the top 23. The user may lay the floor treating machine 70 over on its side with the frame 15 lying on its edge to lockingly attach the impeller member 40 about the floor treating drive means 72 which is connected to the motor means (not shown) of the floor treating machine 70. The user should position the impeller member 40 through the bottom 24 of the stator means 22 with the top side 41 of the impeller member 40 facing the bottom 71 of the floor treating machine 70. The user should slide the impeller member 40 towards the floor treating drive means 72 so that the drive shaft extends into the aperture 44 of the clutch member 43. A wrench or tool can be used to securely attach the impeller member 40 to the floor treating drive means 72 as is conventionally done with the floor treating element supports of the prior art. Once the impeller member 40 is securely fastened to the drive means 72, the corrugated end portion of the spindles 52 should be engageable to the downward facing surface of the annular projection means 36 of the stator means 22. The floor treating element support 60 should be rotatably attached to and extending below the impeller member 40 with the speed accelerator means disposed between the impeller member 40 and the floor treating element support 60. Once mounted upon the frame, the floor treating machine 70 can be set upright ready for use with the frame 15 generally horizontally disposed parallel to the floor 85. The user can adjust the height of the frame 15 by threadingly adjusting the fasteners (not shown) on the stems 30'', 31'', & 32'' of the roller members 30, 31, & 32 to raise or lower the roller members 30, 31, & 32 relative to the frame 15. To actuate the high-speed conversion means, the user should activate the motor on the floor treating machine 70 which will actuate the floor treating drive means 72 which rotates the impeller member 40 at the same rotational speed as the floor treating drive means 72 which is approximately 175 rpm to 300 rpm. As the impeller member 40 rotates with the floor treating drive means 72, the six speed accelerator means move along with the impeller member 40 about the axis of the impeller member 40 and the corrugated end portion of the spindles 52 engage the annular projection means 36 and rotate at speeds in excess of 2500 rpm which also is the speed of the roller means 53 of which the corrugated rim of the roller means 53 rotatably engages the rubber platform 63 of the floor treating element support 60 and actuates rotation of the floor treating element support 60 at comparable speeds to the roller means 53. The impeller member 40 when actuated rotates relative to the annular projection means 36 which doesn't rotate but remains stationary and moves only with the frame 15 upon the floor 85. The rotation of the impeller member 40 effects movement of the speed accelerator means upon which the spindles 52 engage the surface of the annular projection means 36 which effects rotation of the spindles 52 which effects rotation of the roller means 53 which effects rotation of the floor treating element support 60 which effects rotation of the floor treating elements 68 fastenably attached thereto for treating floors 85. The circumferences of the spindles 52 are much smaller, as much as fifty times smaller, than the circumference of the impeller member 40. As a result of the differences in the circumferences of the spindles and the impeller member 40, the spindles and roller means, which actuate rotation of the floor treating element support 60, rotates in excess of 50 times faster than that of the impeller member 40 and are capable of rotating in excess of 2500 rpm as compared to 300 rpm by the impeller member 40. High-speed floor treating elements 68 such as brushes and pads are detachably attached to the floor facing side 62 of the floor treating element support 60 and are rotatably engageable to the floor 85 for the treatment such as burnishing, waxing, stripping, sanding, or cleaning thereof.

Various changes and departures may be made without departing from the spirit and scope thereof. Accordingly, it is not intended that the invention be limited to that specifically described in the drawings but only as set forth in the claims.

What is claimed is:

1. High-speed conversion means for floor treating machines comprising:

a height adjustable and moveable frame supported on wheels and having a stator means, for supporting a floor treating machine;

an impeller member removably received in said stator means and securely fastenable to a rotatable floor treating drive means of said floor treating machine for rotation therewith;

a floor treating element support rotatably journaled to said impeller member, for high speed rotation relative to said impeller member;

at least one floor treating element fastenable to said floor treating element support for engageably treating floors; and a plurality of speed accelerator means fixedly attached to said impeller member and engageable to said floor treating element support for effecting high-speed rotation of said floor treating element support.

2. High-speed conversion means for floor treating machines as described in claim 1, wherein said stator means comprises a top, an open bottom, an annular side wall, and an opening through said top.

3. High-speed conversion means for floor treating machines as described in claim 2, wherein said opening is dimensioned to receive said floor treating drive means.

4. High-speed conversion means for floor treating machines as described in claim 2, wherein said frame further comprises an annular projection means extending inside said stator means.

5. High-speed conversion means for floor treating machines as described in claim 2, wherein said speed accelerator means each comprises a bearing member; a spindle having first and second ends and being rotatably journaled through said bearing member; and a roller means fixedly attached at said second end of said spindle and being engageable to said floor treating element support.

6. High-speed conversion means for floor treating machines as described in claim 5, wherein said plurality of spindles are arranged generally parallel to said bottom side of said impeller member.

7. High-speed conversion means for floor treating machines as described in claim 6, wherein each of said spindles have a portion extending outside beyond the perimeter of said impeller member.

8. High-speed conversion means for floor treating machines as described in claim 7, wherein each of said portion of said spindles is positioned for engagement to said floor treating element support.

9. High-speed conversion means for floor treating machines as described in claim 8, wherein said spindles have circumferential dimensions relative smaller than that of said impeller member drive said floor treating element support to speeds capable of exceeding 2500 rpm.

10. High-speed conversion means for floor treating machines as described in claim 1, wherein said impeller member is essentially disk-shaped and further has a top side and a bottom side.

11. High-speed conversion means for floor treating machines as described in claim 11, wherein said impeller member has a clutch member extending upward from said top side thereof and having an aperture therein, said aperture being dimensioned for mountably receiving said floor treating drive means which effects rotation of said impeller member.

12. High-speed conversion means for floor treating machines as described in claim 11, wherein said impeller member further has a bore extending through said bottom side of said impeller member.

13. High-speed conversion means for floor treating machines as described in claim 1, wherein said floor treating element support is essentially disk-shaped and further has a top side and a bottom side.

14. High-speed conversion means for floor treating machines as described in claim 13, wherein said floor treating element support has an axle member centrally disposed upon said top side thereof and rotatably journaled to said impeller member.

15. High-speed conversion means for floor treating machines as described in claim 13, wherein said floor treating element support has a generally circular platform centrally disposed upon said top side thereof for engaging said speed accelerator means.

16. High-speed conversion means for floor treating machines as described in claim 15, wherein said speed accelerator means comprise a plurality of spindles which engage said platform of said floor treating element support to drive said floor treating element support to speeds capable of exceeding 2500 rpm.

17. High-speed conversion means for floor treating machines as described in claim 1, wherein said floor treating element is a brush.

18. High-speed conversion means for floor treating machines as described in claim 1, wherein said floor treating element is a pad.

19. High-speed conversion means for floor treating machines as described in claim 1, wherein said floor treating element is sand paper.

* * * * *